United States Patent [19]

Bohan

[11] Patent Number: 4,542,688

[45] Date of Patent: Sep. 24, 1985

[54] CONTAINER DISPOSAL APPARATUS

[76] Inventor: Phillip Bohan, 127 S. Walnut St., Quincy, Mass. 02169

[21] Appl. No.: 467,641

[22] Filed: Feb. 18, 1983

[51] Int. Cl.[4] ..... B30B 9/32

[52] U.S. Cl. ..... 100/173; 100/176; 100/902; 194/4 C; 241/99; 273/138 A

[58] Field of Search ..... 241/99; 273/138 A; 194/4 C; 100/902, 176, 173

[56] References Cited

U.S. PATENT DOCUMENTS

| | | | |
|---|---|---|---|
| 3,655,138 | 4/1972 | Luscombe | 241/99 |
| 3,776,128 | 12/1973 | Morris | 100/176 X |
| 3,857,334 | 12/1974 | Arp | 100/902 X |
| 4,119,024 | 10/1978 | White | 100/902 X |
| 4,257,511 | 3/1981 | Miller | 100/902 X |
| 4,324,325 | 4/1982 | DeWoolfson | 100/902 X |
| 4,358,995 | 11/1982 | Ballo | 100/902 X |

*Primary Examiner*—Billy J. Wilhite

*Attorney, Agent, or Firm*—Cesari and McKenna

[57] ABSTRACT

A container disposal apparatus raises containers to an elevated position from which they traverse a downwardly inclined chute. Rotatable interrupter plates associated with the chute intermittently align apertures of limited extent with the chute so as to pass along the chute containers arriving at the interrupter plates when the apertures are aligned with the chute and to clear them from the chute otherwise. Containers successfully traversing two successive interrupter plates trigger prize-dispensing mechanism.

11 Claims, 7 Drawing Figures

CONTAINER DISPOSAL APPARATUS

BACKGROUND OF THE INVENTION

1. Field of the Invention

The invention relates to container disposal apparatus and, more particularly, to apparatus for collecting and storing, for subsequent disposal, containers such as bottles, cans, and the like.

2. Prior Art

Continued concern for the environment, as well as for the need to conserve resources, has led to the proposal of a number of different machines for collecting and storing used containers. Some of these machines receive and break down the containers, e.g., U.S. Pat. No. 3,655,138 (Luscombe) (bottles); U.S. Pat. No. 3,776,128 (Morris) (cans). Others additionally dispense tokens or other elements of value in exchange, e.g., U.S. Pat. No. 3,857,334 (Arp); U.S. Pat. No. 4,324,325 (De Woolfson).

Such machines are frequently unduly complex for the simple task they are to perform, and thus are costly to manufacture. Further, while the offering of a monetary return may encourage a marginally greater number of individuals to dispose of their containers in the machine, it is uneconomic to provide a return of sufficient value to each user to insure that significant numbers of individuals will do so.

BRIEF DESCRIPTION OF THE INVENTION

Objects of the Invention

Accordingly, it is an object of the invention to provide an improved container disposal apparatus.

Further, it is an object of the invention to provide a container disposal apparatus that is simple in design and thus economical to construct.

It is another object of the invention to provide a container disposal apparatus that will induce utilization by a large number of individuals.

Brief Summary of the Invention

In accordance with the present invention, I provide a container disposal apparatus having a storage bin or other container for receiving containers and storing them for subsequent disposal; a lift for receiving a container and carrying it to an elevated height; and a main chute extending from a position near the top of the conveyor at one end to a position discharging into the storage bin at the other end for conveying to the bin containers which are supplied to it by the lift. One or more interrupter mechanisms associated with the main chute periodically present a "window" to containers in the chute so that containers in the vicinity of the interrupters at that time are passed along the chute; otherwise they are diverted to a disposal bin. In the preferred construction of the invention described herein, the interrupter comprises a plate extending through the chute and having an aperture through a section thereof which is periodically rotated into alignment with the chute. Containers successfully transiting at least two diverter stations are returned to the user for a bonus turn and a prize is dispensed to the user.

The apparatus of the present invention is simple in design and construction, and therefore may economically be constructed. Further, it provides to the user an element of chance, and thus presents a simple "game" at which the user can try his or her "skill." Under the circumstances, human nature is such that even a prize of comparatively insignificant value can induce users to "play the game" and thus assist in disposing of used containers. Indeed, it is expected that the apparatus will attract a large number of users merely because of the element of chance involved, even without the provision of a prize. Thus, it is expected to be effective in helping to maintain the environment.

DETAILED DESCRIPTION OF THE INVENTION

The foregoing and other and further objects and features of the invention will be more readily understood in reference to the following detailed description of the invention, when taken in conjunction with the accompanying drawings, in which.

Figure 1:
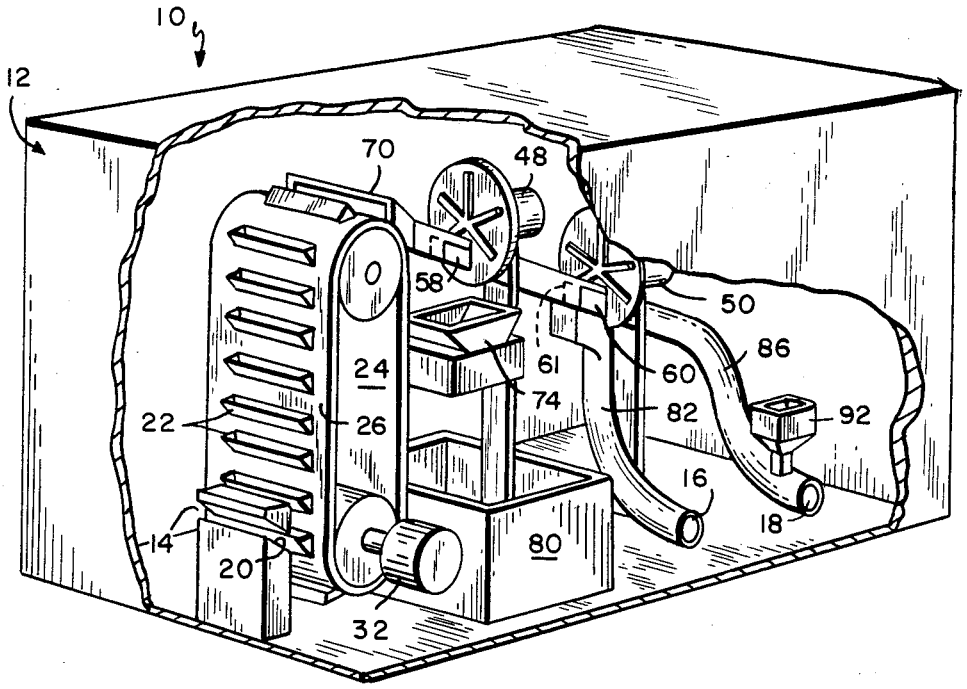
FIG. 1 is a view in perspective of a container disposal apparatus in accordance with the present invention.
Figure 2:
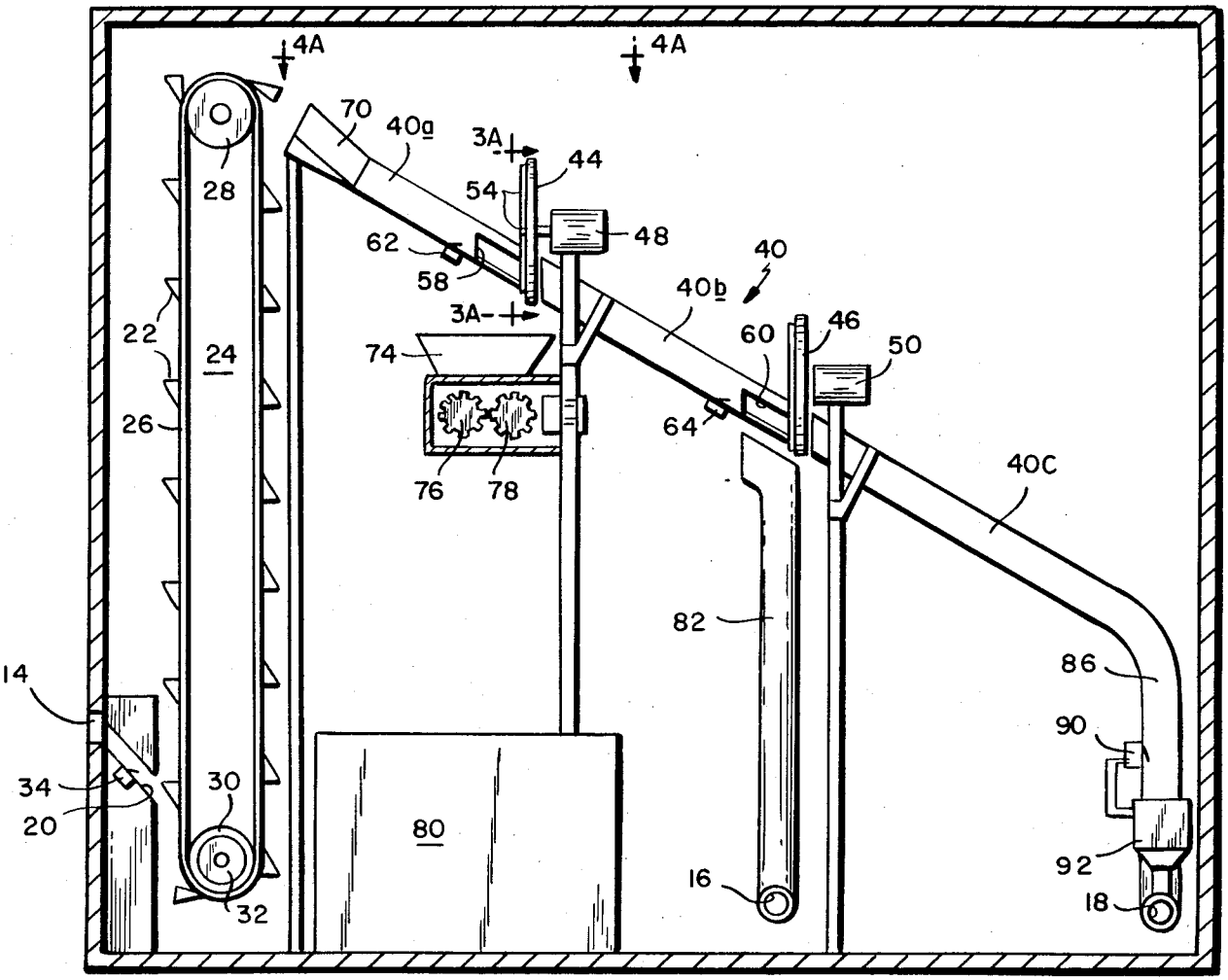
FIG. 2 is a side vertical sectional view of the apparatus of FIG. 1 showing the operation of the invention in detail.

In FIGS. 1 and 2, a container disposal apparatus 10 in accordance with the present invention comprises a housing 12 having a first opening 14 for receiving a container to be disposed of and a second and third openings 16 and 18, respectively, for returning containers to the user. The opening 14 has a downwardly inclined ramp 20 which carries the container to one of the scoops 22 of a conveyor 24. The conveyor 24 is formed from a continuous belt 26 extending over pulleys 28 and 30, respectively. The pulley 30 is driven by a motor 32. A microswitch 34 energizes motor 32 when a container passes over it and the motor 32 remains energized for at least the time required to carry the container to the top of the conveyor and transfer it to the next stage as now described in detail.

Figure 3A:
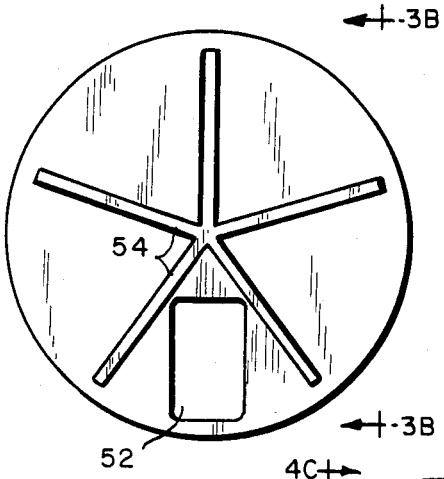
FIG. 3A is a frontal vertical view along the lines 3A—3A of FIG. 2 showing an interrupter plate in accordance with the present invention.
Figure 3B:
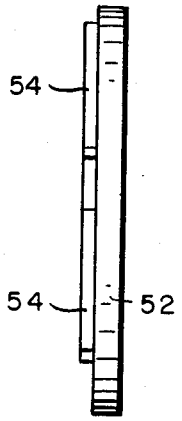
FIG. 3B is a side elevational view along lines 3B—3B of FIG. 3A.

A main chute 40 extends downwardly from an upper portion of the conveyor 24 at one end to a lower elevation at the other end. Containers supplied to the chute from the conveyor slide down the chute by force of gravity. The chute 40 is divided into three segments 40*a*, 40*b* and 40*c* which are separated from each other by interruptor plates 44, 46 driven by motors 48, 50 respectively. The motors are actuated by microswitch 34 for a period of time sufficient to allow containers in the chute to pass through the chute or be cleared from it. The plates, which are shown in more detail in FIGS. 3A, 3B, and 4C, each comprise a generally circular plate having an aperture 52 extending therethrough in alignment with the chute 40. These plates block the passage of containers through the chute except during the brief interval in which a container is aligned with the aperture.

Distributed about the plates are striker bars 54 extending in a generally radial direction. These striker bars clear from the chute any containers which have been stopped by the plate because they have failed to pass through the aperture 52. To this end apertures 58 and 59 are formed on opposite sides of the chute immediately in front of plate 44. Similar apertures, one of which, aperture 60, can be seen in FIG. 2, are formed in front of plate 46. The apertures are shaped to allow passage of a container therethrough when propelled by the striker bars. Microswitches 62, 64 positioned "slightly upstream" of the plates 44, 46 detect the presence of more than one container in the vicinity of the interrupter plate at any given time for reasons to be described subsequently.

Figure 4A:
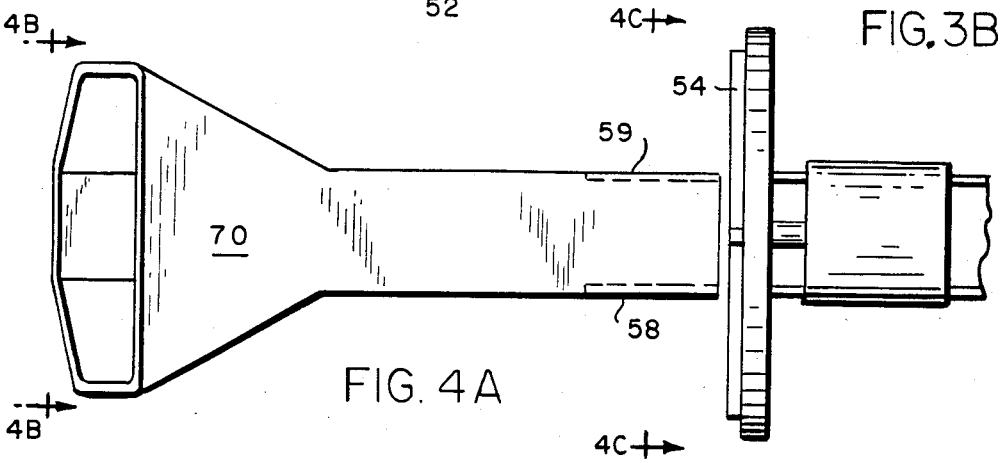
FIGS. 4A–C are side, frontal, and top views, respectively, of a portion of the container chute.
Figure 4B:
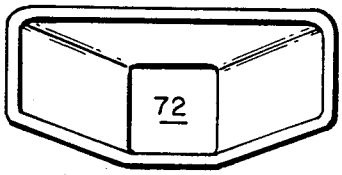
Figure 4C:
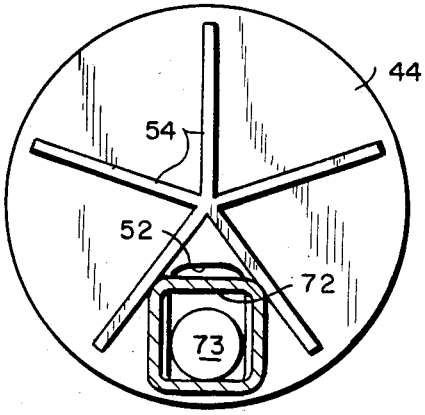

The upper end of the chute 40 is formed with a widened throat 70 which flares upwardly and outwardly to receive containers from the conveyor 24. The bottom wall of the chute extends downwardly toward the center from the sides to thereby form a central channel 72 which extends along the remainder of the chute and which accommodates a container therein with the longitudinal axis of the container 73 aligned with the longitudinal axis of the chute as shown in FIG. 4C.

Vertically aligned with apertures 58 and 59 of chute 40 is a crusher hopper 74. This hopper feeds the containers exiting from the apertures 58 and 59 to crusher rollers 76, 78, respectively. For containers such as metal cans and the like, the rollers 76, 78 preferably have slightly serrated faces so as to grip the cans and pull them into the "nip" between the rollers. The crushed cans then exit from the rollers and fall into a bin 80. For containers such as bottles, the faces of the rollers may be more sharply serrated, if it is desired to break the bottles, or may be omitted entirely if the bottles are merely to be dropped into the bins without crushing. In the latter case, provision may be made to cushion the impact of the bottles so that they do not break on dropping into the bin.

In operation, the user deposits a container in aperture 14. The container travels along ramp 20 and falls into one of the scoops 22 on conveyor 24. It is then carried upwardly to the top of the conveyor and transferred to chute 40. The bottom face of throat 70 aligns the longitudinal axis of the container with the longitudinal axis of the chute 40 (that is, an axis extending along the path of the container as it passes through the chute) so that the container presents its narrow cross-sections to the interrupter plates 44, 46. Should the container arrive at either of these interrupter plates at a time when the apertures of these plates are aligned with the chute 40, the container passes through the aperture in the interrupter plate and continues its journey through the chute. If, however, the container arrives at an interrupter plate at a time when the aperture of the plate is not aligned with the chute, the container is brought to a halt in the chute by the interrupter plate. One of the bars 54 of the interrupter plate then sweeps the container outwardly through, in the case of plate 44, aperture 58 or 59, and the container then falls downwardly into the hopper 74. In the case of plate 46, the container is swept outwardly through aperture 60, or the aperture (not shown) opposite it, into a chute 82 and out through the second opening 16.

If the container passes both of the interrupter plates successfully, it is dropped into chute 86 for return to the user who may then try his or her luck a further time. At the same time, a microswitch 90 in the path of chute 86 detects the passage of a container down this chute and causes the dispensing of a prize from the hopper 92. The prize may be money, candy, or any other item of value. If it passes only one of the plates, i.e., plate 44, it drops into chute 82 and is returned to the user for another try, but without a prize.

The percentage of containers which successfully pass through the diverter plates 44, 46 is dependent on the number and size of apertures 52 and the rotational speed of the diverter plate, among other factors. In order to insure a relatively constant "pay off" rate, it is desirable to randomize the time interval during which the diverter plates are rotated in order to insure that the aperture 52 will be at a random position at the start of a useage cycle. Further, in order to prevent the possibility of affecting the odds of winning by feeding containers at such intervals or in such quantities as to cause a pile up of containers at the diverter plate, the microswitch 62 senses the presence of more than one container adjacent each diverter plate and causes the diverter plate to oscillate back and forth through an arc corresponding to the distance between two adjacent striker bars 54 so as to repeatedly clear the chute of stacked up containers when this occurs.

Conclusion

From the foregoing, it will be seen that I have provided an improved container disposal apparatus. The construction of the device is simple, and is expected that it will be economical to produce. Further, by incorporating an element of chance into the disposal process, it is expected to entice a significantly larger number of users than might otherwise be possible. Accordingly, it is expected to be beneficial to the environment.

Various changes may be made to the foregoing without departing from either the spirit or the scope of the invention and it is intended that the foregoing be taken as illustrative only, and not in a limiting sense, the scope of the invention being defined with particularity in the claims.

I claim:

1. Container disposal apparatus comprising:

A. a lift for moving a container to an elevated position;

B. means for storing a plurality of containers;

C. means forming a main chute for conveying containers along a main chute path from said elevated position to said container storage means;

D. means for receiving containers selectively diverted to it from said main chute; and E. interrupter means co-operating with said main chute to intermittently divert into said container-receiving means containers passing along said main chute; said interrupter means comprising a plate having an aperture intermittently placed in alignment with the main chute path for selectively passing containers therealong.

2. Container disposal apparatus according to claim 1 in which said plate is rotatably mounted for intermittent rotational alignment of said aperture with the path of said containers in said main chute.

3. Container disposal apparatus according to claim 2 in which said plate includes at least one striker bar thereon for removing from said main chute containers whose travel through the chute is blocked by said interrupter plate.

4. Container disposal apparatus according to claim 3 which includes a prize dispensing means actuated in response to passage of a container past said interrupter means without being diverted thereby.

5. Container disposal apparatus according to claim 4 wherein said container-receiving means includes a crusher for crushing containers diverted to it from said main chute.

6. Apparatus according to claim 1 in which said lift comprises a vertically-oriented conveyor having container-receiving scoops spaced along the conveyor.

7. Container disposal apparatus for receiving and storing containers, comprising:

A. a vertically-oriented conveyor having a plurality of spaced scoops for receiving containers therein and carrying them to an elevated position;

B. means forming a downwardly angled main chute extending from a position adjacent an upper end of said conveyor;

C. interrupter means positioned to selectively pass containers along said main chute;

D. at least one diverter chute positioned to receive containers successfully passing said interrupter means and to return them to the user;

E. a storage bin for receiving containers whose passage along said chute is blocked by said interrupter means at a position below said elevated position; and F. means responsive to diversion of a container to provide a reward to the user.

8. Container disposal apparatus according to claim 7 in which said interrupter means comprises a plate intermittently moved into the travel path of containers in said main chute and having at least one aperture to pass containers therethrough when aligned with said chute, said plate blocking passage of said containers when said aperture is not aligned with said chute.

9. Container disposal apparatus according to claim 8 in which said interrupter plate further includes a plurality of radially extending striker bars on a face thereof for clearing from said chute containers which have failed to pass through said aperture.

10. Container disposal apparatus comprising:

A. a lift for moving a container to an elevated position;

B. means for storing a plurality of containers;

c. means forming a main chute for conveying containers from said elevated position to said container storage means;

D. means for receiving containers selectively diverted to it from said main chute;

E. interrupter means co-operating with said main chute to intermittently divert into said container-receiving means containers passing along said main chute; and F. a prize dispensing means actuated in response to passage of a container past said interrupter means without being diverted thereby.

11. Container disposal apparatus according to claim 10 wherein said container-receiving means includes a crusher for crushing containers diverted to it from said main chute.

* * * * *